US011325158B2

(12) United States Patent
Sosnowski

(10) Patent No.: US 11,325,158 B2
(45) Date of Patent: May 10, 2022

(54) SIEVE DEVICE FOR FINE CLEANING OF GRAINY MATERIAL

(71) Applicant: Wlodzimierz Sosnowski, Ciechanow (PL)

(72) Inventor: Wlodzimierz Sosnowski, Ciechanow (PL)

( * ) Notice: Subject to any disclaimer, the term of this patent is extended or adjusted under 35 U.S.C. 154(b) by 54 days.

(21) Appl. No.: 16/815,154

(22) Filed: Mar. 11, 2020

(65) Prior Publication Data

US 2020/0290087 A1 Sep. 17, 2020

(30) Foreign Application Priority Data

Mar. 12, 2019 (PL) ..... P.429238

(51) Int. Cl.
*B07B 1/46* (2006.01)

(52) U.S. Cl.
CPC ..... *B07B 1/4609* (2013.01); *B07B 2201/04* (2013.01)

(58) Field of Classification Search
CPC ..... B07B 1/4609; B07B 2201/04
USPC ..... 209/353, 354, 355
See application file for complete search history.

(56) References Cited

U.S. PATENT DOCUMENTS 1,398,275 A * 11/1921 Petteys ..... B07B 1/30 209/354
1,537,511 A * 5/1925 Ulfseth ..... B02B 1/02 209/384
2,236,934 A * 4/1941 Benedict ..... B07B 1/38 209/257
2,334,707 A * 11/1943 Johnson ..... B07B 1/49 209/403
3,370,705 A 2/1968 Grulke
3,688,902 A * 9/1972 Hubach ..... B07B 13/04 209/240
4,236,998 A * 12/1980 Heys ..... D21D 5/04 209/235
4,250,678 A * 2/1981 Skuran ..... E04F 13/0876 52/478
4,322,288 A * 3/1982 Schmidt ..... B02B 1/02 209/240
4,652,362 A 3/1987 Mueller
7,416,085 B2 8/2008 Kadel
(Continued)

FOREIGN PATENT DOCUMENTS

WO 2017/179999 A1 10/2017

*Primary Examiner* — Terrell H Matthews
(74) *Attorney, Agent, or Firm* — WHDA, LLP

(57) ABSTRACT

A sieve device for fine-cleaning of grainy material after preliminary cleaning in an aspirator, having an inclined body made of separably integrated frames, in which replaceable stationary sieve are placed one below the other, the upper sieve having openings corresponding to the size of the grain, and the lower sieve having openings smaller than the grain, while a charging hopper is mounted in the upper, peripheral part of the body above the upper sieve. The each sieve consists of cascading identical flat sieve segments connected in sequence by z-shaped connectors, so that the planes of all sieve segments are parallel and above each z-shaped connector there is a set of plates mounted pendulously and independently on a bracket mounted on the frame of the body above the sieve, parallel to the z-shaped connector, the combined width of the plates in the set corresponding to the width of the sieve segment.

8 Claims, 3 Drawing Sheets

(56) References Cited

U.S. PATENT DOCUMENTS

| | | | | |
|---|---|---|---|---|
| 8,636,150 | B1 * | 1/2014 | Akers, Jr. | B07B 1/282<br>209/314 |
| 2012/0018548 | A1 * | 1/2012 | Andela | B03B 9/062<br>241/24.19 |
| 2013/0220945 | A1 * | 8/2013 | Carr | E21B 21/01<br>210/768 |

* cited by examiner

SIEVE DEVICE FOR FINE CLEANING OF GRAINY MATERIAL

TECHNICAL FIELD

The object of the invention is a sieve device for fine cleaning of grainy material, in particular final fine cleaning of heavier contaminants after preliminary removal of light contaminants by an aspirator drawing air during gravitational falling of grainy material.

BACKGROUND ART

From international publication of invention no. WO 2017/179999 (corresponding to U.S. Pat. No. 10,702,890 B2), belonging to the applicant of the present invention, there is a known aspirator for separating and removing light contaminants from grainy material, having a body, in whose upper part there is an air-drawing fan, and in the central part there is an axially mounted charging hopper connected to an inlet of grainy material, wherein in the lower part there is a module in the form of a centripetal guide consisting of a cylindrical housing, on whose inner surface there are guiding plates distributed uniformly at a certain distance from each other, in various transverse planes, with their ends facing the axis of the device, so that plates in one plane are offset relative to plates in the neighbouring plane. Between the charging hopper and the centripetal guide, constituting a separate module, there is a module in the form of a cylinder, inside which there is a centrifugal guide having the form of an axial bracket, on whose surface there are guiding elements mounted in various transverse planes, with their ends facing the inner wall of the cylinder. A stream of grainy material falling gravitationally from the charging hopper is dispersed centrifugally or centripetally by the guiding elements, which results in providing thorough and highly efficient purging of light contaminants, which are drawn by the fan and directed outside, and the cleaned grainy material is directed gravitationally out of the lower outlet of the body. Unfortunately, the aspirator does not solve the problem of purging the grainy material of larger and heavier contaminants, especially stones or shells. Flat, cylindrical or conical sieves, usually mobile, pendulous and vibrating or rotating, are used to remove this type of contaminants. The sieves are made of perforated sheet metal or a metal mesh, or of plastic, flat sieves usually having multiple levels. Sets of flat sieves are usually provided with a fan generating a jet of air upwards from under the lower sieve, which is supposed to remove lighter contaminants from sieve surfaces, as well as to restore openings in the sieves. Alternatively or jointly, the restoration of clogged openings uses shaking devices in the form of balls or bars moving under the openings. The efficiency of cleaning grainy material in a set of flat sieves depends largely on the thick-ness of the layer of material on the sieve, the shape and size of openings in the sieve, the speed of material sliding on the sieve and the length of the sieve. Stationary flat sieves are cheap to produce and operate, with the speed of sliding being adjusted by the inclination of the sieve. Longer sieves allow more thorough cleaning of the material, but they prolong the cleaning process. When increasing the angle of inclination of the sieve, the sliding speed is increased and the layer of material is reduced, while obstruction of openings in the sieve may occur due to the grain having higher kinetic energy, resulting in jumping upward through the edges of the openings. From U.S. Pat. No. 3,370,705 there is a known device for cleaning corn grain, having a two-layered flat sieve made of a plastic mesh, placed at an angle between the outlet of a supplying conveyor and an inlet into grain storage, wherein the angle of inclination can be adjusted by means of a vertical stand pro-vided at various heights with openings with a lock. The device is provided with a vibrator and a fan, and scrapers removing contaminants remaining after the blowing are placed on the surface of the lower sieve. U.S. Pat. No. 4,652,362 in turn presents a device for separating heavy contaminants, especially stones, from grains and other bulk goods by means of two flat, parallel, inclined vibrating tables in the form of a sieve with a layered construction, through which a stream of air is directed from the lower table towards the top, generally perpendicular to their surface. Light contaminants are removed from the up-per table and heavier material is conveyed to the lower table, where it is separated into grain removed from the lower end of the table and stones removed from the upper end of the table. There is a known cleaner for cereals, corn, rapeseed, sunflower or legumes by the name of SEED 45, offered by the German RIELA company, where the cleaning process takes place on two flat sieves mounted at a small angle in the body, the upper sieve having perforation with openings larger than the lower sieve. Material coarser than the grain re-mains on the upper sieve and grain remains on the lower sieve, while fine contaminants pass through the lower sieve and are directed outside, all light contaminants being removed by means of an aspirator. Moreover, there are known cleaning machines from the Danish DAMAS company, intended for preliminary and main cleaning of numerous cereal species and seeds. For example, the VIBAM machine has a box with flat sieves, onto which the material is conveyed upon initial aspiration. The sieves are used to remove husks, shells, small seeds, weeds, sand as well as large and heavy contaminants which cannot be removed by means of airflow. In the box there are at least three flat sieves mounted at an angle, the upper and central sieves removing coarse contaminants, larger than the grain, and the lower sieve separating sand and fine weeds. A similar rule was used in the OMEGA machine, while the small UNISEED machine and the large DUOSEED machine of this producer used a vibrating drive for the sieves. In all of the abovementioned ma-chines the sieves are replaceable, and their selection depends on the size and type of grain, the restoration of obstructed openings in sieves taking place by means of rubber balls. A sieve in the form of a mat can be cleaned by the device known from U.S. Pat. No. 7,416,085, comprising shaking elements placed under the sieve mat, which strike against the bottom of the mat, cleaning it of the screened product obstructing the openings, the shaking elements being mounted on at least one elongated tight band, like a rope or a tape, which extends below the mat. The sieve surface is made of replaceable elements which by means of a frame protruding downwards surround the sieve mat on all sides, while the ends of the band are mounted on the frame of the sieve element, wherein the shaking elements preferably constitute balls. There is also a known machine by the name of LACA for cleaning the grain of oil plants, manufactured by the German BUHLER company. This machine uses an arrangement of two flat sieves connected to a vibrator.

SUMMARY OF THE INVENTION

The objective of the present invention is to improve the efficiency of fine cleaning, in particular of heavy and large contaminants, of grainy material which has been preliminarily cleaned of light contaminants in an aspirator, in particular in the aspirator presented in publication no. WO 2017/179999 (corresponding to U.S. Pat. No. 10,702,890 B2).

The essence of the invention constitutes the construction of a sieve device for fine cleaning of grainy material after preliminary cleaning in an aspirator, having an inclined body made of separably integrated frames, in which replaceable stationary sieves are placed one below the other, the upper sieve having openings corresponding to the size of the grain, and the lower sieve having openings smaller than the grain, while a charging hopper is mounted in the upper, peripheral part of the body above the upper sieve. According to the invention, each sieve consists of cascading identical flat sieve segments connected in sequence by z-shaped connectors, so that the planes of all sieve segments are parallel and above each z-shaped connector there is a set of plates mounted pendulously and independently on a bracket mounted on the frame of the body above the sieve, parallel to the z-shaped connector, the combined width of plates in the set corresponding to the width of the sieve segment. The body along with the sieves is inclined relative to the ground level at an angle no lower than 5° and no higher than 55°. Said body is suspended on the supporting construction of an aspirator by means of bands of adjustable length, the charging hopper being placed under the outlet of the aspirator. Preferably, the device can be provided with a beater mechanism striking cyclically against the body. The location of the brackets along with a set of plates relative to the sieve segments and relative to z-shaped connectors is adjustable. When fine-cleaning light grainy material of a small size, the plates at rest are positioned near the edge of a higher situated sieve segment, and the lower edge of the plates is away from the surface of a lower situated sieve segment by a distance of slightly less than the grain size. When fine-cleaning heavy grainy material of a large size, the lower edge of the plates at rest leans against the surface of a lower situated sieve segment. The ratio of the distance between the planes of adjacent sieve segments to the length of the sieve segment is no less than 0.03 and no more than 0.25, while the ratio of the length of the sieve segment to the width of the sieve segment is no less than 0.25 and no more than 0.5. Due to such construction, completely clean grain is achieved with small financial expenses, since stationary sieves are cheap due to their simplicity and easy to operate.

DETAILED DESCRIPTION

Figure 1:
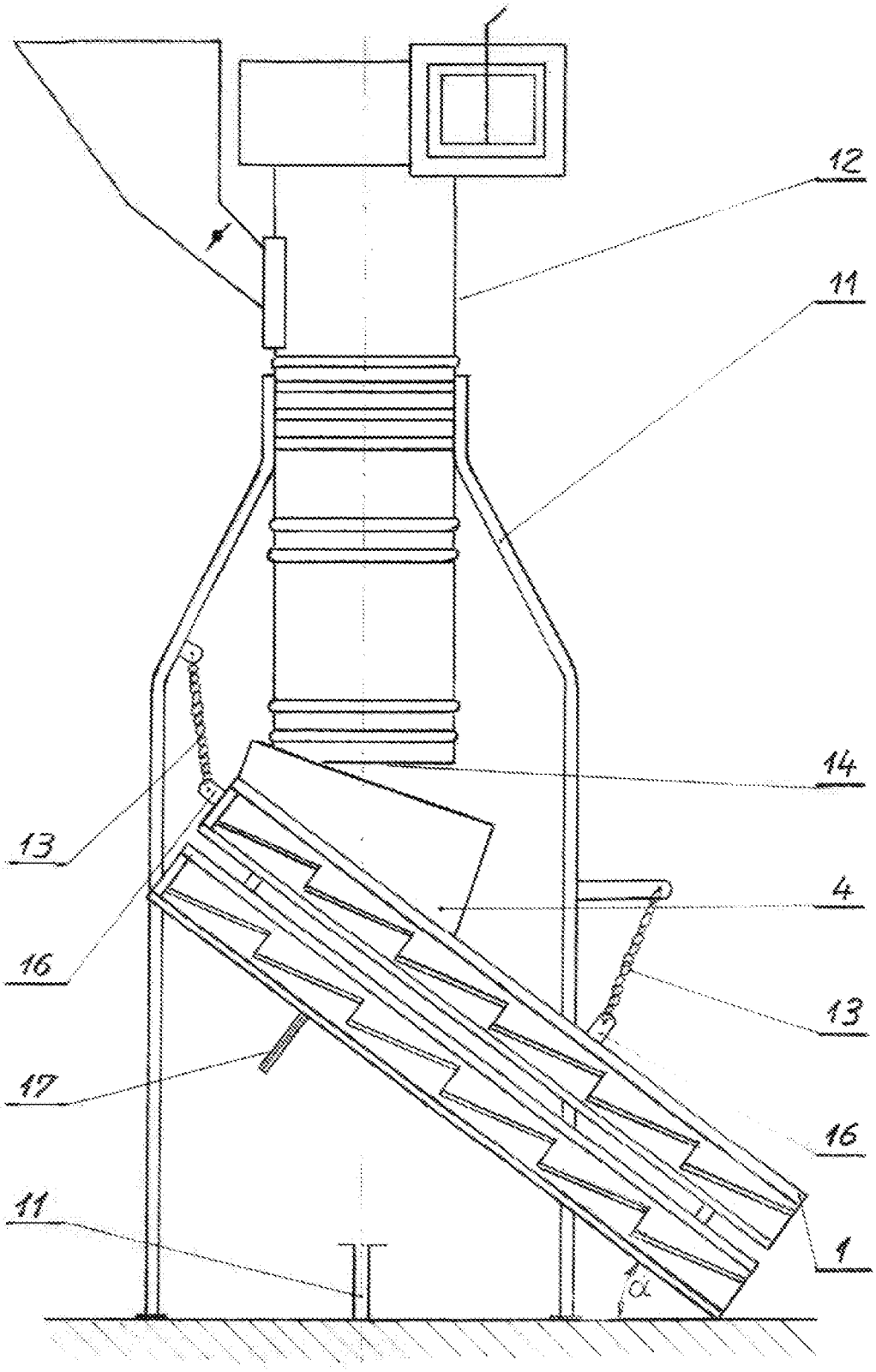
FIG. 1 presents schematically a complete body suspended under the outlet of an aspirator.
Figure 2:
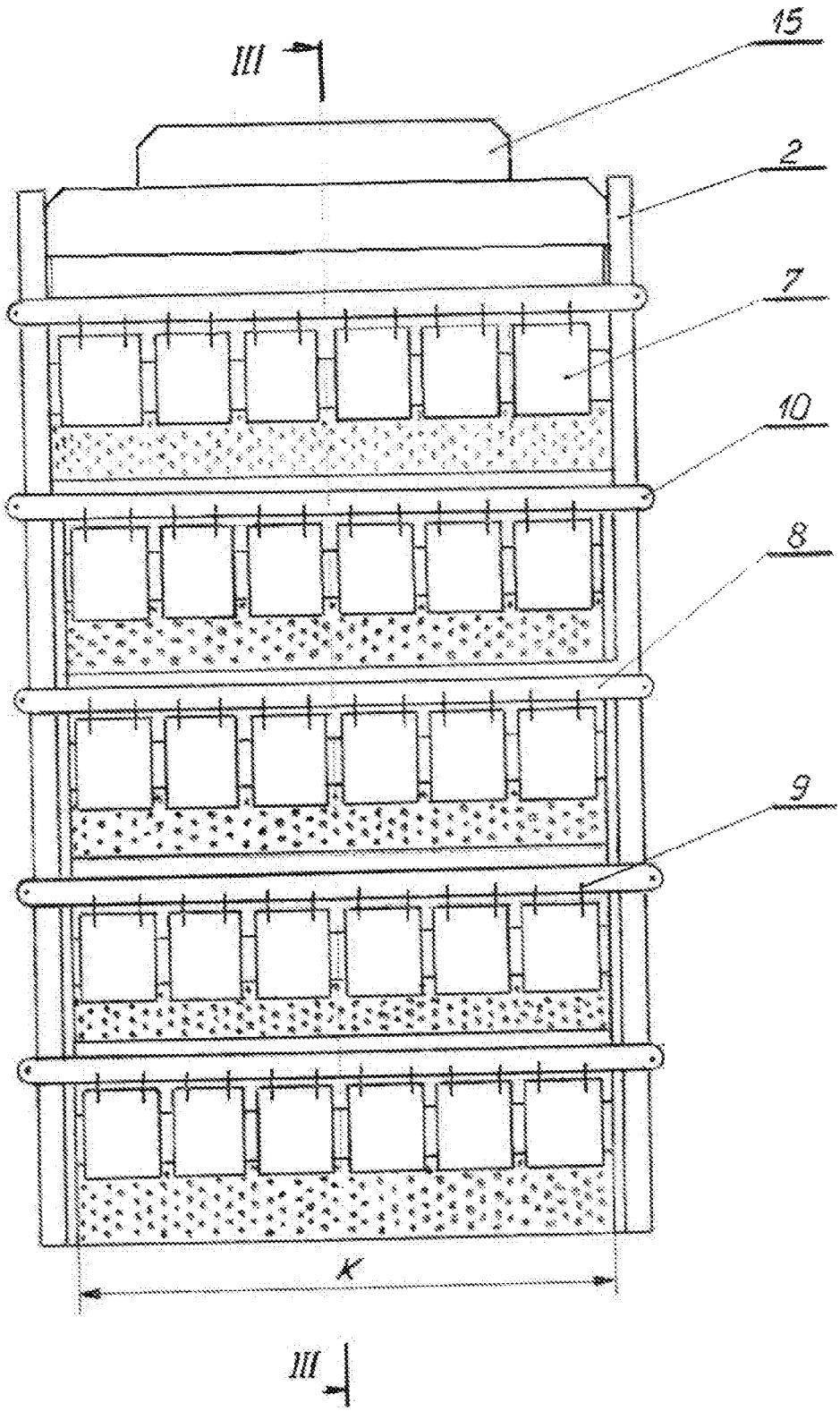
FIG. 2 presents a simplified view without a charging hopper.
Figure 3:
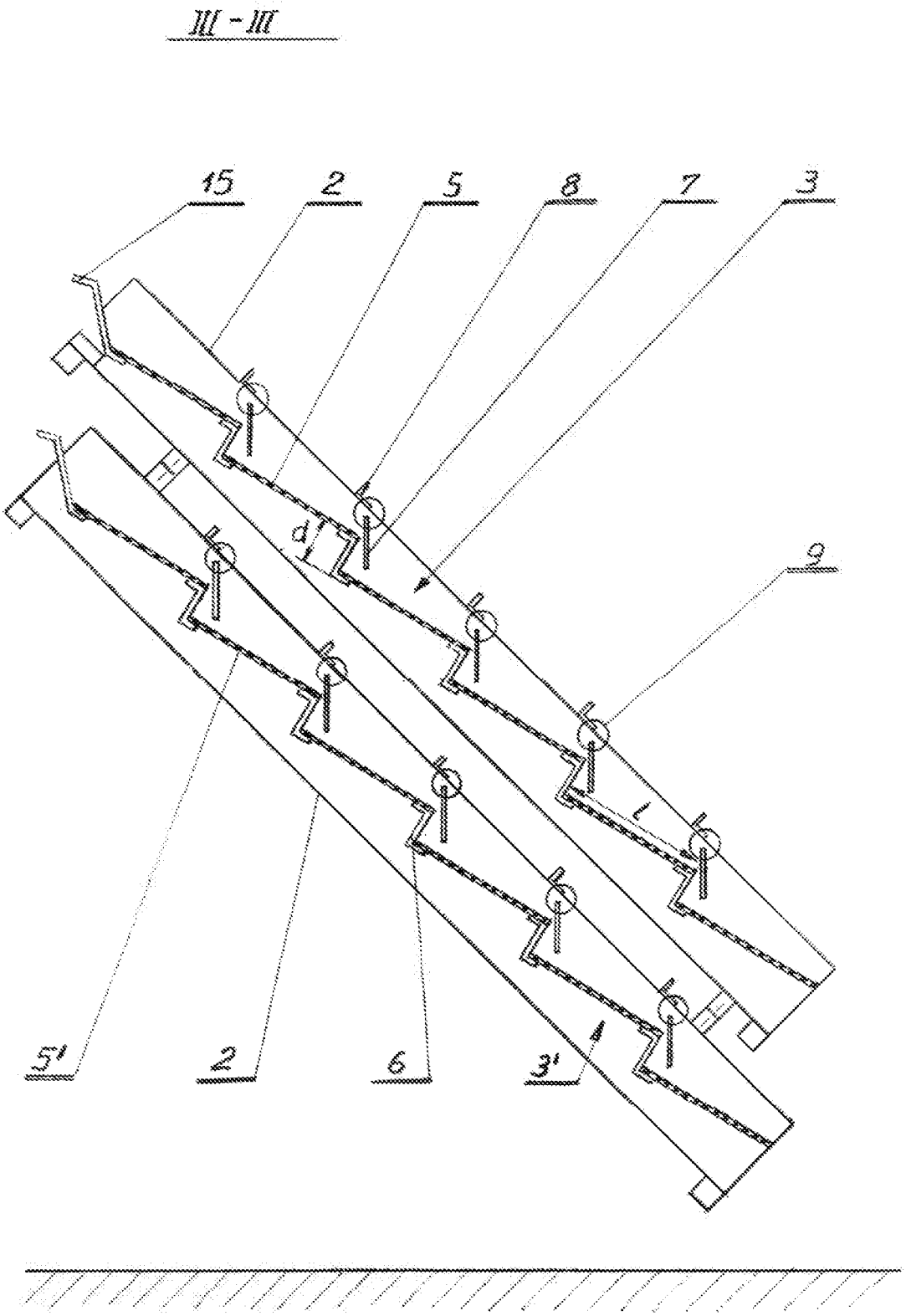
FIG. 3 presents a cross-sectional view along the line of FIG. 2.

The device according to the invention is illustrated in an embodiment in the drawing.

The body 1 consists of two identical frames 2 separably connected to each other. The upper sieve 3 having openings corresponding to the grain size is placed in the upper frame 2, and the lower sieve 3' having openings smaller than the grain is placed in the lower frame 2. The charging hopper 4 is mounted in the higher part of the body 1, above the upper sieve 3. The upper sieve 3 consists of cascading identical flat sieve segments 5 with openings corresponding to the grain size, and the lower sieve 3' consists of identical flat sieve segments 5' with smaller openings. The adjacent segments 5 and the adjacent segments 5' are connected to each other by a z-shaped connector 6, so that the planes of all sieve segments 5, 5' are parallel. Above each z-shaped connector 6 there is a set of plates 7 mounted pendulously and independently on a bracket 8 mounted on the frame 2 of the body 1 above the sieve 3 and 3', parallel to the z-shaped connector (6), the combined width of the set of plates 7 corresponding to the width of the sieve segment 5, 5'. Each plate 7 in the set is suspended on the bracket 8 by means of two circular hangers 9. The brackets 8 are mounted on the frames 2 by means of bolts 10, which enable both raising and moving the brackets 8 relative to the frame 2. The body 1 along with the sieves 3, 3' is suspended on the supporting construction 11 of the aspirator 12 by means of bands 13 with an adjustable length, so that it is inclined relative to the ground at an angle $\alpha$ ranging from 5° to 55°, the charging hopper 4 being placed under the outlet 14 of the aspirator 12. Next to the hopper 4, in the end of the upper frame 2 there is a flange 15 shielding against accidentally dropped grain. Moreover, the frame 2 in its upper and lower part has hooks 16 used to mount the bands 13. In order to facilitate the removal of grain obstructing the openings in the sieve 3 or contaminants in the sieve 3', it is possible to use a beater mechanism 17 striking against the body 1 with the sieves 3, 3'. When fine-cleaning light grainy material of a small size, the plates 7 at rest are positioned near the edge of the higher situated sieve segment 5, 5', and the lower edge of the plates 7 is away from the surface of the lower situated sieve segment 5, 5' by a distance of less than the grain size, which allows avoiding the blocking of light grain, for example grass grain, on the plates 7 when sliding on the sieve segments 5, 5'. When fine-cleaning heavy grainy material of a large size, the lower edge of the plates (7) at rest leans against the surface of the lower situated sieve segment 5, 5', which allows cleaning of the sliding grain, for example corn, with higher efficiency. It has been determined empirically that a preferable result of cleaning grainy material can be achieved with a ratio of the distance d between the planes of adjacent sieve segments 5 or 5' to the length 1 of the sieve segment 5, 5' of no less than 0.03 and no more than 0.25, and with the ratio of the length 1 of the sieve segment 5, 5' to its width k of no less than 0.25 and no more than 0.5.

The operation of the device is as follows: grainy material cleaned of light contaminants in the aspirator 12 falls out of the outlet 14 directly into the charging hopper 4 placed on the body 1 suspended on the supporting construction 11, and when sliding on the sieve segments 5 with openings corresponding to the grain size, it passes onto the lower sieve 3' positioned below, with openings smaller than the grain size. After reaching the edge of the z-shaped connector 6 it encounters an obstruction in the form of a set of plates 7, on which it loses its kinetic energy, so that on the next segment 5 it begins its travel with a zero velocity, wherein the steadily moving grain cleans the obstructed openings. Such a process is repeated on each sieve segment 5, and only large contaminants remain at the end of the sieve 3, falling into a trough placed outside. A similar process is repeated on the lower sieve 3', except grain and fine heavy contaminants are present on sieve segments 5', falling through openings smaller than the grain below the sieve 3', and the grain slides on the subsequent segments 5' to be ultimately received via a conveyor in a store-house.

What is claimed is:

1. A sieve device for fine-cleaning of grainy material, having an inclined body made of separably integrated frames, in which replaceable stationary sieves including an upper sieve and a lower sieve stationary within the inclined body are placed one below the other, the upper sieve having openings corresponding to the size of the grain, and the lower sieve having openings smaller than the grain, while a charging hopper is mounted in the upper, peripheral part of the body above the upper sieve, and each sieve consists of cascading identical flat sieve segments connected in sequence by z-shaped connectors, so that the planes of all sieve segments are parallel, characterised in that above each z-shaped connector there is a set of plates mounted pendulously and independently on a bracket mounted on the frame of the body above the sieve, parallel to the z-shaped connector, the combined width of the plates in the set corresponding to the width of the sieve segment;

and the ratio of the distance between the planes of adjacent sieve segments to the length (l) of the sieve segment fulfils the condition $$0.03 \leq \frac{d}{l} \leq 0.25,$$

and the ratio of the length (l) of the sieve segment to the width (k) of the sieve segment fulfils the condition $$0.25 \leq \frac{l}{k} \leq 0.5.$$

2. The device according to claim 1, characterised in that the body along with the sieves is inclined relative to the ground at an angle ($\alpha$) fulfilling the condition $5° \leq \alpha \leq 55°$.

3. The device according to claim 2, characterised in that the body further comprises bands with an adjustable length configured to support the body.

4. The device according to claim 3, characterised in that the charging hopper is configured to be placed below an outlet of an aspirator.

5. The device according to claim 2, characterised in that it has a beater mechanism cyclically striking against the body.

6. The device according to claim 2, characterised in that the location of the brackets along with a set of plates relative to sieve segments and relative to z-shaped connectors is adjustable.

7. The device according to claim 6, characterised in that when fine-cleaning light grainy material of a small size, the plates at rest are positioned near the edge of the higher situated sieve segment, and the lower edge of the plates is away from the surface of the lower situated sieve segment by a distance of slightly less than the grain size.

8. The device according to claim 6, characterised in that when fine-cleaning heavy grainy material of a large size, the lower edge of the plates at rest leans against the surface of the lower situated sieve segment.

* * * * *